US005923296A

United States Patent [19]

Sanzgiri et al.

[11] Patent Number: 5,923,296

[45] Date of Patent: Jul. 13, 1999

[54] DUAL POLARIZED MICROSTRIP PATCH ANTENNA ARRAY FOR PCS BASE STATIONS

[75] Inventors: Shashi M. Sanzgiri, Plano; Paul C. Gilliland, Allen; William P. Harokopus, McKinney; John Svigelj, Plano, all of Tex.

[73] Assignee: Raytheon Company, Lexington, Mass.

[21] Appl. No.: 08/916,598

[22] Filed: Aug. 22, 1997

Related U.S. Application Data

[60] Provisional application No. 60/025,534, Sep. 6, 1996.

[51] Int. Cl.[6] ..... H01Q 1/38

[52] U.S. Cl. ..... 343/700 MS; 343/846

[58] Field of Search ..... 343/700 MS, 846, 343/848, 853; H01Q 1/38

[56] References Cited

U.S. PATENT DOCUMENTS 5,181,042 1/1993 Kaise et al. ..... 343/700 MS

FOREIGN PATENT DOCUMENTS

0271458A1 6/1988 European Pat. Off. .
0345454A1 12/1989 European Pat. Off. .
0484241A1 5/1992 European Pat. Off. .

OTHER PUBLICATIONS

John Huang, "A Technique for an Array to Generate Circular Polarization with Linearly Polarized Elements", IEEE Transactions on Antennas and Propagation, vol. AP–34, Sep. 1986, pp. 1113–1124.

John Huang, "Microstrip Antenna Developments at JPL", IEEE Antennas & Propagation Magazine, 33 (1991) Jun., No. 3, pp. 33–41.

*Primary Examiner*—Hoanganh Le
*Attorney, Agent, or Firm*—Baker & Botts, L.L.P.

[57] ABSTRACT

A dual, preferably orthogonally polarized microstrip patch antenna which includes a layer of electrically insulating material in the form of a printed circuit board. First and second sets of electrically conductive patches, preferably of copper, are disposed on one surface of the electrically insulating material, the first set adapted for transmission and/or reception of electromagnetic radiations polarized in a first direction and the second set adapted for transmission and/or reception of electromagnetic radiations polarized in a second direction. Patches of the first set are interlaced with patches of the second set. A feed for each of the patches is coupled to the opposing surface of the electrically insulating material which includes a first plurality of slots, one associated with each of the patches of the first set for polarizing the patches of the first set in the first direction and a second plurality of slots, one associated with each of the patches of the second set for polarizing the patches of the second set in the second direction. The centers of the patches of the first and second sets of patches are disposed in a straight line and the centers of adjacent patches of each of the sets of patches are spaced apart less than one wavelength of the carrier frequency of interest.

13 Claims, 2 Drawing Sheets

DUAL POLARIZED MICROSTRIP PATCH ANTENNA ARRAY FOR PCS BASE STATIONS

CROSS REFERENCE TO RELATED APPLICATIONS

This application claims priority under 35 USC § 119 of provisional application number 60/025,534, filed Sep. 6, 1996.

BACKGROUND OF THE INVENTION

Field of the Invention

This invention relates to a dual polarized microstrip patch antenna and, more specifically to such an antenna for use in wireless, cellular and personal communication system (PCS) base stations.

Brief Description of the Prior Art

In mobile communications, the signal from a mobile station arrives at the base station from many directions. There are many reasons for this multidirectional reception, examples being reflection of the signal from buildings, terrain and the like of at least a portion of the signal disposed in the path of the signal from the mobile station to the base station. Signals arriving at the base station from different directions add in different amplitudes and phases, causing signal fading. The fading characteristics depend upon the speed of the mobile station and the character of the surrounding reflective obstacles. Signals can fade by as much as 40 dB, thereby seriously degrading communication performance.

A common approach to reduce the effects of fading involves reception of signals through several antennas configured appropriately so that received signals tend to be uncorrelated. The distinct antenna signal paths are termed diversity branches. A traditional approach to create diversity branches is to spatially separate the antennas by several carrier signal wavelengths (usually 5 to 10 wavelengths). The signals received by such antennas tend to be decorrelated (i.e., when the signal in one branch goes through a null, the signal in the other branch goes through a peak). The signals in these diversity branches are combined using either switched, equal gain or maximum ratio combining techniques.

The diversity technique used here involves the use of orthogonal polarizations from a common antenna. When the signal (linearly polarized) from a mobile station reaches a base station through a random scattering medium, the signal loses its dominant polarization and the incident power is scattered in all possible polarization states as a function of time. The sampled vertical and horizontal polarization components of the incident field thus provide independent time varying signal paths. The degree of decorrelation depends upon the propagation medium. Thus, in a densely urban area, the orthogonal polarizations are more uncorrelated than in a rural area.

A technique for improving communication has been to receive a signal from an antenna having dual orthogonal polarizations. The traditional method for achieving dual polarization (e.g., vertical and horizontal polarization) from a compact antenna structure has been to provide dual feeds, generally orthogonal to a common radiating element as shown in FIGS. 1*a* and 1*b* wherein the feeds are vertical and horizontal in FIG. 1*a* and at 45° and 135° relative to the horizontal in FIG. 1*b*. The radiating element can take the form of a printed circuit with generally rectangular patches disposed on a surface of an electrical insulator. The patches must be spaced apart from patch center to patch center by less than one wavelength of the carrier frequency and preferably about 0.75 wavelength which is the spacing where peak amplitude reception is generally obtained. The patches are dimensioned to accommodate a predetermined carrier frequency as is well known. The patch is generally fed by either a direct coupled feed on the surface containing the patch to provide signals Lo the patch, a probe feed wherein separate probes extend through the printed circuit board to the patch or by providing a microstrip line on the opposing surface of the printed circuit board with slots to provide slot coupled feeds to the patch, in each case to provide for orthogonal polarization modes.

A common drawback to these prior art approaches using a patch antenna is that the coupling between adjacent feeds limits the level of cross-polarization that can be achieved. Also, it is difficult to achieve equal E and H plane pattern shapes from a common antenna element. Any modifications performed to alter the pattern shape of one polarization tends to detune the resonant frequency of the other polarization.

SUMMARY OF THE INVENTION

In accordance with the present invention, there is provided an antenna which minimizes the problems encountered in the above described prior art antennas and provides a compact antenna structure unlike spatially separated antennas which require a great deal of real estate on the towers on which they are secured. The polarization diverse antennas are therefor suited for towers in the urban areas where zoning laws encourage use of aesthetic and/or stealthy (visual) antennas. To achieve diversity gain through polarization branch processing, the branches require high cross-polarization discrimination. The cross-polarization discrimination relates to the ratio of the signal power in the co-polarized branch to that in the cross-polarized branch. This is also a degree of coupling between the two polarization branches. To maintain a high degree of decorrelation between the two branches, a cross-polarization discrimination is often sought with values greater than 25 dB.

The antenna in accordance with the present invention which accomplishes the above described ends uses an interleaved patch antenna array wherein a first set of alternate patches of electrically conductive material, preferably copper, provides polarization in a first direction and a second set of alternate patches provides polarization in a different and generally orthogonal direction. The distance between the centers of patches from the same set of patches (alternate patches) is less than one wavelength of the carrier frequency and preferably a distance which provides maximum gain, this distance generally being in the vicinity of 0.75 of the carrier signal wavelength, this distance depending upon antenna material and other factors. The patch dimensions vary according to frequency and are generally about 1 inch by about 2¼ inches at 1900 MHz, though these dimensions will vary with carrier signal frequency. The patch dimensions must be such as to permit a patch of the second polarization to be disposed between a pair of adjacent patches of the first polarization without overlap or touching another patch. By interleaving the patches providing the signals having the two different polarizations, there is a decreased coupling between signals having the two different polarizations and there is provided independent control of the pattern shapes for the two polarizations to balance coverage in the preferred horizontal and vertical orientation. This is accomplished by dimensioning the patches of each set to accommodate the polarization type which they must handle. The cross polarization discrimination of greater than 25 dB is achieved across a field of view of up to 90 degrees using an interleaved dual polarized patch antenna array approach. The cross-polarization discrimination achieved using conventional approaches is less than 15 dB across a 90 degree field of view. To achieve maximum diversity, it is also desired that the pattern response of the two polarizations components be identical over a wide field of view. Having independent radiating elements for two polarizations allows freedom to optimize performance of each polarization branch for any desired polarization.

To reduce the cross-polarization further, aperture coupled feed is provided. This feeding method permits microstrip or stripline feed to be placed away from the antenna side of the printed circuit board and below the antenna ground plane. The ground plane shields stray radiation from the microstrip feed, thus eliminating contamination of the polarization radiated by the patch antenna.

The antenna array columns used for the base stations normally provide fixed broadside beams. The spacing between elements is normally close to a wavelength. The present invention involves using the space between the elements to interleave orthogonally polarized elements. In this manner, two independent, isolated and orthogonally polarized arrays are accommodated in a single column.

DESCRIPTION OF THE PREFERRED EMBODIMENTS

Figure 1A:
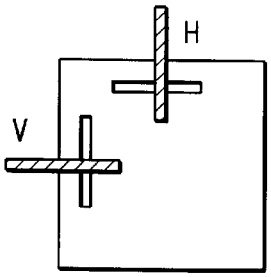
FIGS. 1*a* and 1*b* schematic diagrams of the traditional method for achieving dual polarization (e.g., vertical and horizontal polarization) from a compact antenna structure by providing dual feeds wherein the feeds are vertical and horizontal in FIG. 1*a* and at 45° and 135° relative to the horizontal in FIG. 1*b;*
Figure 1B:
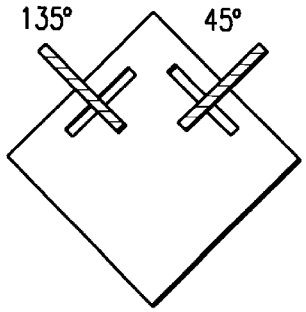
Figure 2:
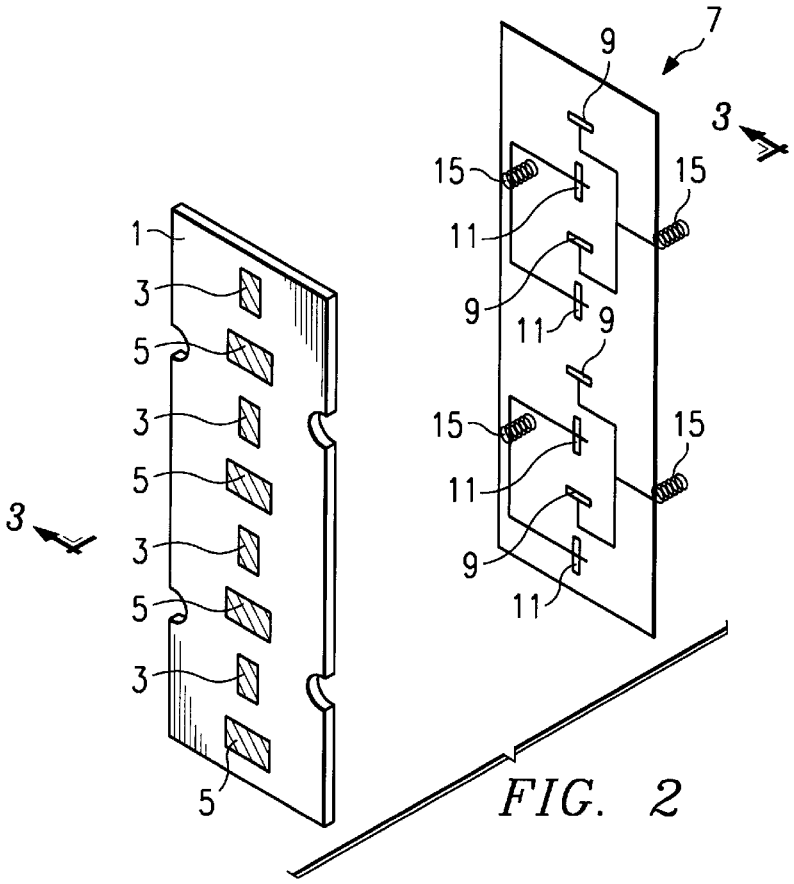
FIG. 2 is an exploded view of a microstrip patch antenna array in accordance with the present invention.

Referring to FIG. 2, there is shown an exploded view of an antenna in accordance with the present invention. The antenna includes a standard printed circuit board 1 of electrically insulating material having a surface containing vertically polarized elements or patches of copper 3 and horizontally polarized elements or patches of copper 5. The patch centers are all disposed in a straight line. Disposed on the opposing surface of the printed circuit board 1 is an aperture coupled feedboard 7 for the patches 3 and 5. Slots 9 of the feed 7 provide vertical polarization, each to an associated patch 3 and slots 11 provide horizontal polarization, each to an associated patch 5 in standard manner wherein each of the slots 9 is aligned with one of the patches 3 and each of the slots 11 is aligned with one of the patches 5. The slots 9 and 11 determine the polarization of the patches 3 and 5, it being understood that the patches 3 and 5 must also be properly dimensioned to be excited by the associated slot with the desired polarization.

Figure 3:
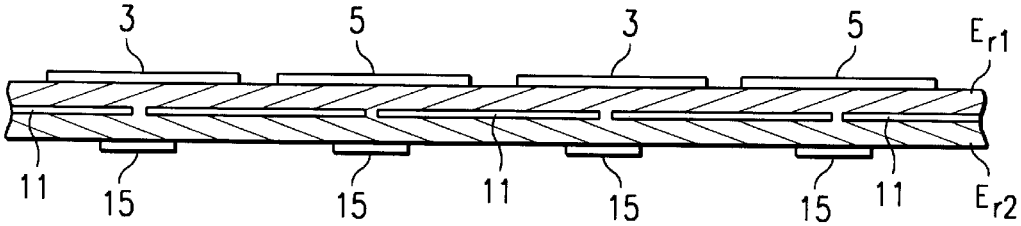
FIG. 3 is a cross section taken along the line 3—3 of FIG. 2.

FIG. 3 provides a cross section showing the printed circuit board 1 having a top substrate portion 20 and bottom substrate portion 22 with patches 3, 5 coupled to the aperture coupled feed 9, 11. The ground plane 13 which is disposed between the substrate portions 20 and 22 separates patch antennas 3, 5 from the feed structure 15. The feed structure 15 is either a microstrip or stripline classification. The substrate portion 20 near the patch antennas 3, 5 is selected to be a low dielectric constant material with dielectric constant less than about 2.0, whereas the substrate portion 22 near the feed structure 15 is selected to be of high dielectric constant with dielectric constant greater than about 3.0.

Figure 4:
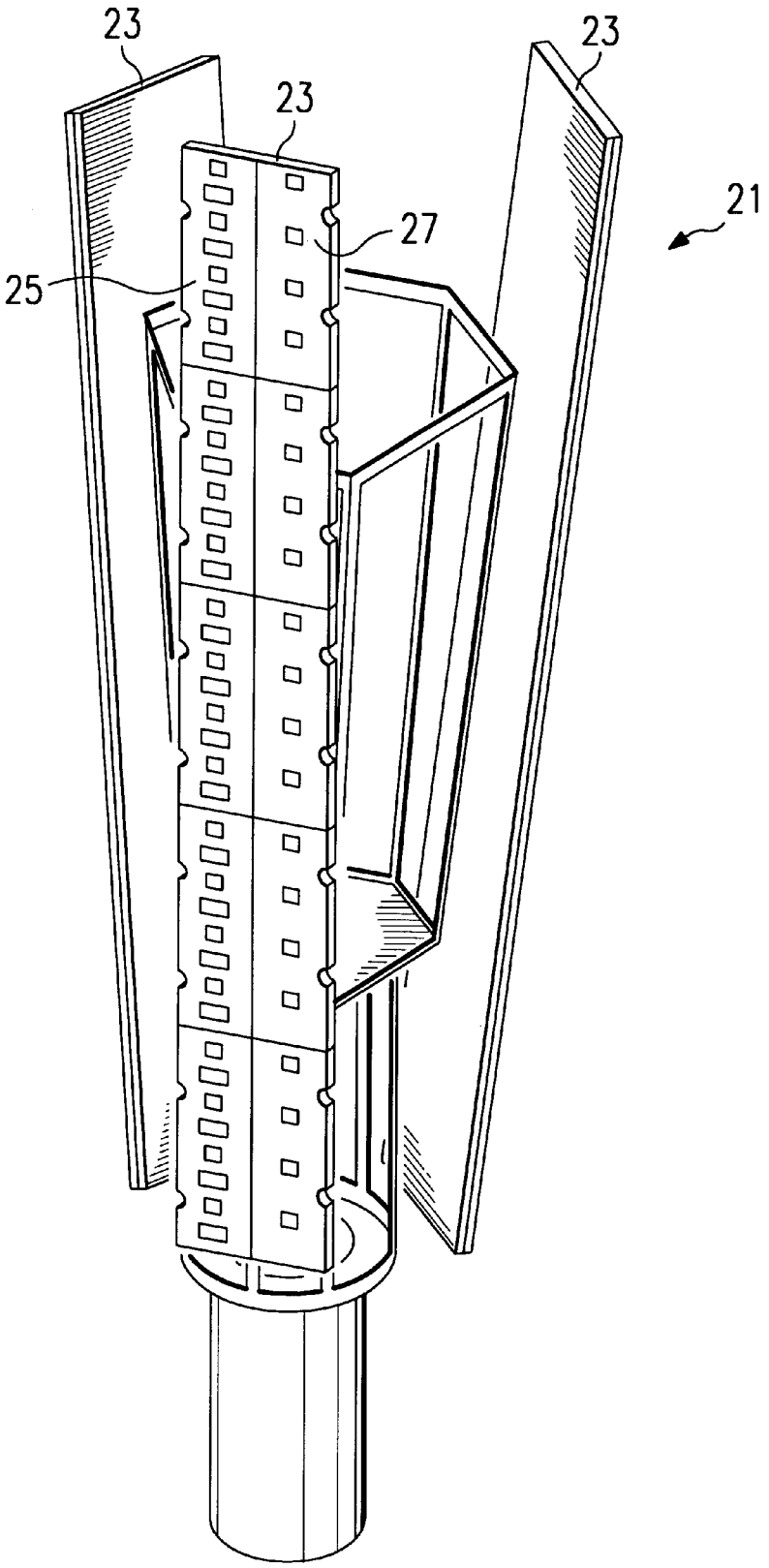
FIG. 4 is an elevational view of a base tower using an antenna in accordance with the present invention.

Referring to FIG. 4, there is shown a typical base station tower 21 using plural diverse antenna sets 23 spaced apart by 120 degrees, one antenna 25 of each antenna set being the antenna of the subject invention as described in connection with FIGS. 2 and 3 and the other antenna 27 of each antenna set being a different type of patch antenna. The antennas are connected for operation in standard manner, the connection therefore not being a part of the present invention and not being described herein.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modification.

We claim:

1. An antenna which comprises:

(a) a substrate of electrically insulating material having first and second surfaces on opposite sides thereof;

(b) a first set and a second set of electrically conductive patches disposed on said first surface of said electrically insulating material, said patches of said first set being adapted for transmission and/or reception of electromagnetic radiations polarized in a first direction and said patches of said second set being adapted for transmission and/or reception of electromagnetic radiations polarized in a second direction which is different from said first direction, said patches of said first set being alternatingly interleaved with said patches of said second set such that said patches of said first and second sets together form a single column of patches, and (c) a feed arrangement provided on said second surface of said electrically insulating material and associated with said patches of said first and second sets, said feed arrangement including a first feed which is operatively coupled to one of said patches of said first set, and a second feed which is operatively coupled to one of said patches of said second set, said second feed being electrically separate from said first feed.

2. The antenna of claim 1, wherein a straight line extends through each of said patches of said first and second sets.

3. The antenna of claim 1 wherein the centers of said patches of said first set and said second set are disposed in a straight line.

4. The antenna of claim 1 wherein said first polarization and said second polarization are orthogonal to each other.

5. The antenna of claim 1, wherein each of said patches of said first set is elongated in one direction, and wherein each of said patches of said second set is elongated in a further direction which is different from said one direction.

6. The antenna of claim 1 wherein said feed arrangement for said patches includes a plurality of first slots, which are each associated with a respective one of said patches of said first set for polarizing said patches of said first set in said first direction, and includes a plurality of second slots, which are each associated with a respective one of said patches of said second set for polarizing said patches of said second set in said second direction.

7. The antenna of claim 6, wherein each of said patches of said first set is elongated in one direction, each of said patches of said second set is elongated in a further direction different from said one direction, each of said first slots extends perpendicular to said one direction, and each of said second slots extends perpendicular to said further direction.

8. The antenna of claim 1 wherein said electrically insulating material is a printed circuit board.

9. The antenna of claim 1 wherein said patches are layers of copper.

10. The antenna of claim 1 wherein the centers of adjacent patches of said first set are spaced apart less than one wavelength of a carrier frequency of interest, and wherein the centers of adjacent patches of said second set are spaced apart less than one wavelength of a carrier frequency of interest.

11. The antenna of claim 1 wherein said substrate includes a relatively low dielectric constant layer disposed adjacent said patches and a relatively high dielectric constant layer disposed adjacent said feed arrangement.

12. The antenna of claim 11 further including a ground plane disposed between said low dielectric constant layer and said high dielectric constant layer.

13. The antenna of claim 1, wherein said first feed is operatively coupled to each of said patches of said first set, and said second feed is operatively coupled to each of said patches of said second set.

* * * * *